US009731860B2

(12) United States Patent
Kretz et al.

(10) Patent No.: US 9,731,860 B2
(45) Date of Patent: Aug. 15, 2017

(54) TRAY WITH INTEGRATED SUPPORT STRUCTURES

(71) Applicant: INTERNATIONAL PAPER COMPANY, Memphis, TN (US)

(72) Inventors: David Kretz, Los Fresnos, TX (US); Mark Hollar, McAllen, TX (US)

(73) Assignee: INTERNATIONAL PAPER COMPANY, Memphis, TN (US)

( * ) Notice: Subject to any disclaimer, the term of this patent is extended or adjusted under 35 U.S.C. 154(b) by 362 days.

(21) Appl. No.: 14/551,401

(22) Filed: Nov. 24, 2014

(65) Prior Publication Data

US 2016/0144998 A1 May 26, 2016

(51) Int. Cl.

| | |
|---|---|
| ***B65D 71/00*** | (2006.01) |
| ***B65D 6/04*** | (2006.01) |
| ***B65D 5/50*** | (2006.01) |
| ***B65D 71/60*** | (2006.01) |
| ***B65D 5/498*** | (2006.01) |

(52) U.S. Cl.

CPC ..... *B65D 5/503* (2013.01); *B65D 5/48048* (2013.01); *B65D 5/5038* (2013.01); *B65D 71/0029* (2013.01)

(58) Field of Classification Search

CPC ..... B65D 5/5038; B65D 5/48048; B65D 71/0029

USPC ..... 206/163, 167, 170, 176–178, 180, 187, 206/561, 562, 565, 549

See application file for complete search history.

(56) References Cited

U.S. PATENT DOCUMENTS

| | | | | |
|---|---|---|---|---|
| 2,701,661 | A * | 2/1955 | Murray | B65D 71/16 206/154 |
| 3,773,214 | A * | 11/1973 | Lemon | B65D 71/48 206/194 |
| 3,899,119 | A | 8/1975 | Roccaforte | |
| 3,921,893 | A | 11/1975 | Randle, Jr. | |
| 3,927,761 | A | 12/1975 | Boyle | |
| 4,049,116 | A * | 9/1977 | Cope | B65D 71/0037 206/176 |
| 4,158,408 | A | 6/1979 | Thiessen | |
| 4,194,678 | A | 3/1980 | Jasper | |

(Continued)

FOREIGN PATENT DOCUMENTS

| | | |
|---|---|---|
| CN | 203612374 | 5/2014 |
| EP | 2703315 | 3/2014 |
| EP | 2746186 | 6/2014 |

*Primary Examiner* — Luan K Bui

(74) *Attorney, Agent, or Firm* — Matthew M. Elsami; Thomas W. Ryan, III

(57) ABSTRACT

The present invention is to an integrated tray for holding and retaining a plurality of articles contained therein. The integrated tray comprises a tubular open-ended tray having a floor panel and an article support panel that is foldably joined to the floor panel in a spaced apart relationship. The article support panel includes a plurality of apertures formed therein to securely retain the plurality of articles therein. A girder is foldably joined to the floor panel and extending upwardly therefrom and is engaged with the article support panel to form the tubular open-ended tray. At least one divider is configured to be removably attached to the tubular open-ended tray. The at least one divider has at least one web panel extending transversely across the tray and at least one flange panel extending longitudinally of the tray.

13 Claims, 9 Drawing Sheets

(56) References Cited

U.S. PATENT DOCUMENTS

| | | | | |
|---|---|---|---|---|
| 4,448,303 | A | 5/1984 | Beckenfeld | |
| 4,480,746 | A | 11/1984 | Wood | |
| 4,485,922 | A | 12/1984 | Desmond et al. | |
| 4,641,746 | A | 2/1987 | Dornbusch et al. | |
| 5,634,555 | A | 6/1997 | Dunham | |
| 5,725,109 | A | 3/1998 | Moulton et al. | |
| 5,803,264 | A * | 9/1998 | Gersten | B65D 71/004 206/194 |
| 6,068,127 | A * | 5/2000 | Hunter | B65D 5/3621 206/194 |
| 6,247,585 | B1 | 6/2001 | Holley, Jr. | |
| 6,311,842 | B1 | 11/2001 | Minerich et al. | |
| 6,367,632 | B1 | 4/2002 | Green | |
| 6,431,363 | B1 | 8/2002 | Hacker | |
| 6,834,762 | B2 * | 12/2004 | Krisko | B65D 71/0022 206/162 |
| 6,962,260 | B2 | 11/2005 | Jay et al. | |
| 7,604,115 | B2 | 10/2009 | Cuomo | |
| 7,681,723 | B2 | 3/2010 | Cuomo | |
| 8,281,927 | B2 | 10/2012 | Smith | |
| 8,365,917 | B2 | 2/2013 | Olesen | |
| 8,646,608 | B2 | 2/2014 | Struthers et al. | |
| 2008/0217191 | A1 * | 9/2008 | Bates | B65D 71/004 206/194 |
| 2008/0237326 | A1 | 10/2008 | Bates | |
| 2013/0126374 | A1 | 5/2013 | Monti | |
| 2013/0334096 | A1 | 12/2013 | Fath | |

* cited by examiner

TRAY WITH INTEGRATED SUPPORT STRUCTURES

FIELD OF THE INVENTION

This invention relates generally to a tray or container, constructed from paperboard blanks for holding a plurality of articles and more particularly, to a shipping and display tray having integrated support structures which is easily assembled and reduces the amount of paperboard typically used in similar packages.

BACKGROUND OF THE INVENTION

Many products for sale to the public are placed in a primary package that is designed for display at the point of sale. One common practice is to place a quantity of the primary packages in a secondary container for shipping. The retailer must then remove the primary packages from the secondary container and hang them from a hook or place them in another container or on a costly permanent plastic or metal display fixture with spring loaded attachments. This solution is labor intensive and costly to the retailer.

To overcome this problem, packages have been designed that are used for both shipping the primary packages and then displaying them at the point of sale. These packages are especially convenient for the retailer, since it is not necessary for the retailer to remove the articles from a bulk shipping container.

One conventional container for both shipping articles and then displaying them with maximum visual exposure at a point of sale comprises a tray having a smooth bottom wall and relatively narrow upstanding side walls. The articles are supported on the bottom wall and preferably extend above the side walls. For shipping, a cover is placed over the tray loaded with articles or the loaded tray is placed in an outer shipping container to form a shipping package. When the shipping package reaches its destination the tray loaded with articles is removed from the shipping container and placed on a shelf or other surface for display and sale of the items supported in the tray.

A commonly used primary package comprises a blister pack or clamshell package which the article is placed on a sheet of cardboard or plastic and then covered by a plastic sheet or bubble that is sealed around the edges to the sheet. These packages are collectively referred to hereinafter as blister packs or blister cards, but it should be understood that this terminology is intended to cover any generally flat package having at least one substantially straight projecting marginal edge. A plurality of blister packs is placed in upright position in these trays. However, because of their shape and the location of their center of gravity, most blister packs tend to fall over or slide forward at their bottom edge and are therefore no longer supported in an upright position when some of the articles are removed by consumers from the front of the tray. Consequently, for blister packs to be properly displayed in a display tray, it is necessary to provide a support structure to hold the blister packs in an upright position even when some of the blister packs are removed from the front of the tray.

One prior art system that has been proposed utilizes a separate insert positioned in the tray and having slots or protuberances that engage opposite side and/or bottom edges of the blister packs to hold them upright even after some blister packs have been removed from the tray. Other prior art systems comprise specially constructed and folded walls that extend into the interior of the tray and have slots for receiving edges of the blister packs to hold them upright. All of these prior art systems require either additional parts, such as inserts placed in the tray, or excess material to form the specially constructed and folded walls.

Therefore, it is desirable to have an integrated tray or shipping and display tray that supports and displays articles in an upright position for optimum visibility at a point of sale without the need for separate inserts or excess material, thereby minimizing the complexity and cost of such display trays.

SUMMARY OF THE INVENTION

Some of the advantages of the integrated tray or the shipping and display tray of the present invention is: 1) to provide a shipping and display tray made from corrugated paperboard and constructed without the use of glue, staple, tape or others, 2) to incorporate features such as horizontal dividers that would allow for several integrated trays to be stacked on top of one another in two or more rows, 3) to enable the claimed invention to function in a modular fashion, allowing the easy incorporation of parts to improve the horizontal stability of the finally erected structure, and 4) through the addition of locking tabs and other features, the claimed invention would allow the overall design to be easily and ergonomically lifted, as a complete and integrated unit, and placed in the position desired by the customer, either as finished goods ready for shipment, or during the production process, by moving the tray structure containing work-in-process materials.

Other advantages of the present invention are: 1) when erected, the claimed invention forms an integrated tray, comprises of a floor panel and an article support panel into which apertures can be placed, conforming to the shape of the articles to be stored in the integrated tray. 2) The size and shape of the apertures in the article support panel can be placed in any configuration, and the height between the floor panel and the article support panel can be either increased or decreased, depending on the type of product to be packaged, and the shape of the articles to be packed. 3) Once assembled, the design incorporates a girder or handle panel or center beam having two handle panels extending upwardly in contiguous relationship to one another. 4) This beam provides for longitudinal stability and forms a structure onto which separate parts can be easily attached, providing for the required horizontal stability. 5) The girder or handle panel or center beam can incorporate hand-holds, if desired, to allow for the entire unit to be easily moved, either during the production process, or when placing it on the final pallet for shipment. 6) The girder or handle panel or center beam can be designed with female slots in it which horizontal dividers could be inserted, thus firmly affixing these dividers to the tubular open-ended tray and providing for horizontal stability and top to bottom compression capability. 7) Based on the shape and size of the articles to be packaged in the shipping and display tray, the horizontal dividers can be inserted at multiple points and in the number required for the needed top to bottom compression and horizontal stability. 8) These dividers by employing the use of slots and locking tabs, can be affixed to the tray assembly, allowing the entire tray assembly to be moved, with or without product, from one point to another, while ensuring that the dividers retain their shape, and remain placed at the sides of the tray, thus counteracting any memory in the dividers, which might cause the edges of these dividers to move away from the sides of the tray, thus increasing the overall footprint of the finally assembled structure, and impeding its efficient movement through space. 9) The dividers and tray can be manufactured in such a way as to be printed with information and graphics enabling them to be suitable for a point of purchase display. 10) Depending on the weight and characteristics of the product to be packed, the overall design of the invention can use a combination of singlewall and doublewall material to achieve the design objectives in terms of overall compression, graphics characteristics and do so while minimizing the material costs of the combined unit.

Accordingly, one aspect of the present invention is directed to an integrated tray for holding and retaining a plurality of articles contained therein. The integrated tray comprises a tubular open-ended tray having a floor panel and an article support panel that is foldably joined to the floor panel in a spaced apart relationship. The article support panel includes a plurality of apertures formed therein to securely retain the plurality of articles therein. A girder is foldably joined to the floor panel and extending upwardly therefrom and is engaged with the article support panel to form the tubular open-ended tray. At least one divider is configured to be removably attached to the tubular open-ended tray. The at least one divider has at least one web panel extending transversely across the tray and at least one flange panel extending longitudinally of the tray.

Another aspect of the present invention is directed to a shipping and display tray for holding and retaining a plurality of articles contained therein in an upright position at a point of sale. The shipping and display tray comprises a tubular open-ended tray folded from a single unitary blank and includes an article support panel having a plurality of apertures therein for supporting articles in the upright position. Opposite side walls are foldably joined to longitudinal opposite sides of the article support panel and extending downwardly therefrom. The floor panels are foldably joined to each of the side walls and extending inwardly from the respective side walls toward one another beneath the article support panel in spaced relationship to the article support panel. A handle panel is foldably joined to each of the floor panels and extending upwardly in contiguous relationship to one another through a slot in the article support panel to form a carry handle for the tray. At least one divider is removably attached to the tubular open-ended tray so as to provide compression capability when the shipping and display trays are stacked on top of one another. The at least one divider includes at least one web panel extending transversely across the tray and at least one flange extending longitudinally of the tray.

A further aspect of the present invention is directed to a plurality of blanks constructed with respect to one another for making an integrated tray. The plurality of blanks comprises a first blank that includes an article support panel having a plurality of apertures formed therein. The article support panel includes an elongated slot formed in a central portion thereof. Opposite side wall panels are foldably joined to longitudinal opposite sides of the article support panel via first fold lines. Floor panels each of which is foldably joined to each of the respective side wall panels via second fold lines. Girder panels each of which having two female slots formed therein and is foldably joined to the respective floor panels via third fold lines to form a tubular open-ended tray when the first blank being constructed. Two identical blanks are defined by second and third blanks each of which comprises two identical rectangular-shaped panels foldably joined to one another. Each of the two rectangular-shaped panels includes two flange panels each of which is foldably extend from respective opposed ends of the rectangular-shaped panel. Each of the two rectangular-shaped panels includes a male slot formed therein which is engaged with the female slot of the girder panels when the blanks are constructed. Each of the two flange panels includes a locking tab projected from respective free edges thereof.

BRIEF DESCRIPTION OF THE DRAWINGS

A full understanding of the invention can be gained from the following description of the preferred embodiments when read in conjunction with the accompanying drawings in which.

DETAIL DESCRIPTION OF THE INVENTION

Figure 1:
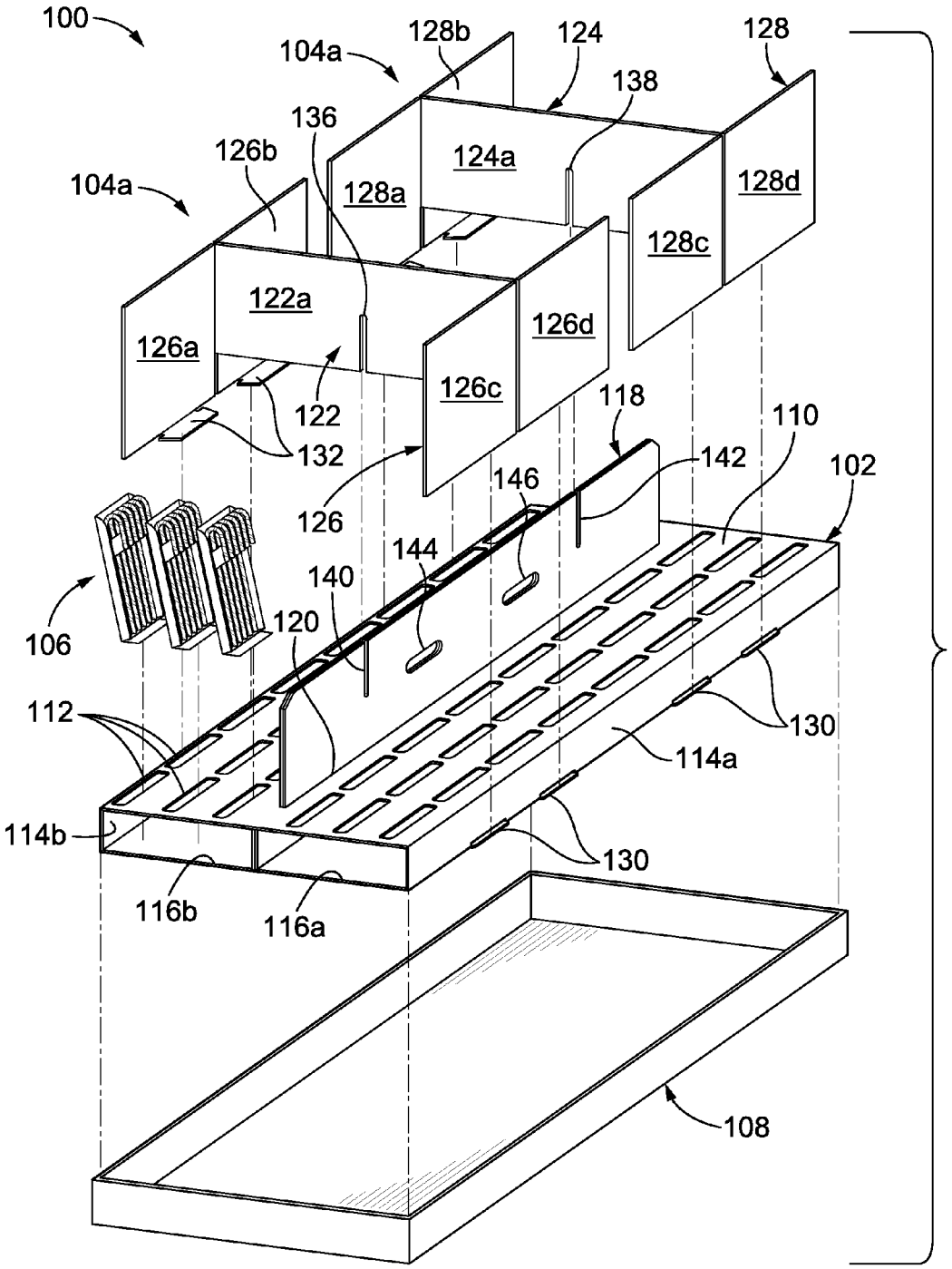
FIG. 1 is an exploded perspective view of an integrated tray having a tubular open-ended tray in spaced relationship with articles, two dividers, and an optional support pad in accordance to a preferred embodiment of the invention.

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated. In the present invention the use of prime character in the numeral references in the drawings directed to the different embodiment indicate that those elements are either the same or at least function the same or those elements are in the unfolded position.

Figure 3:
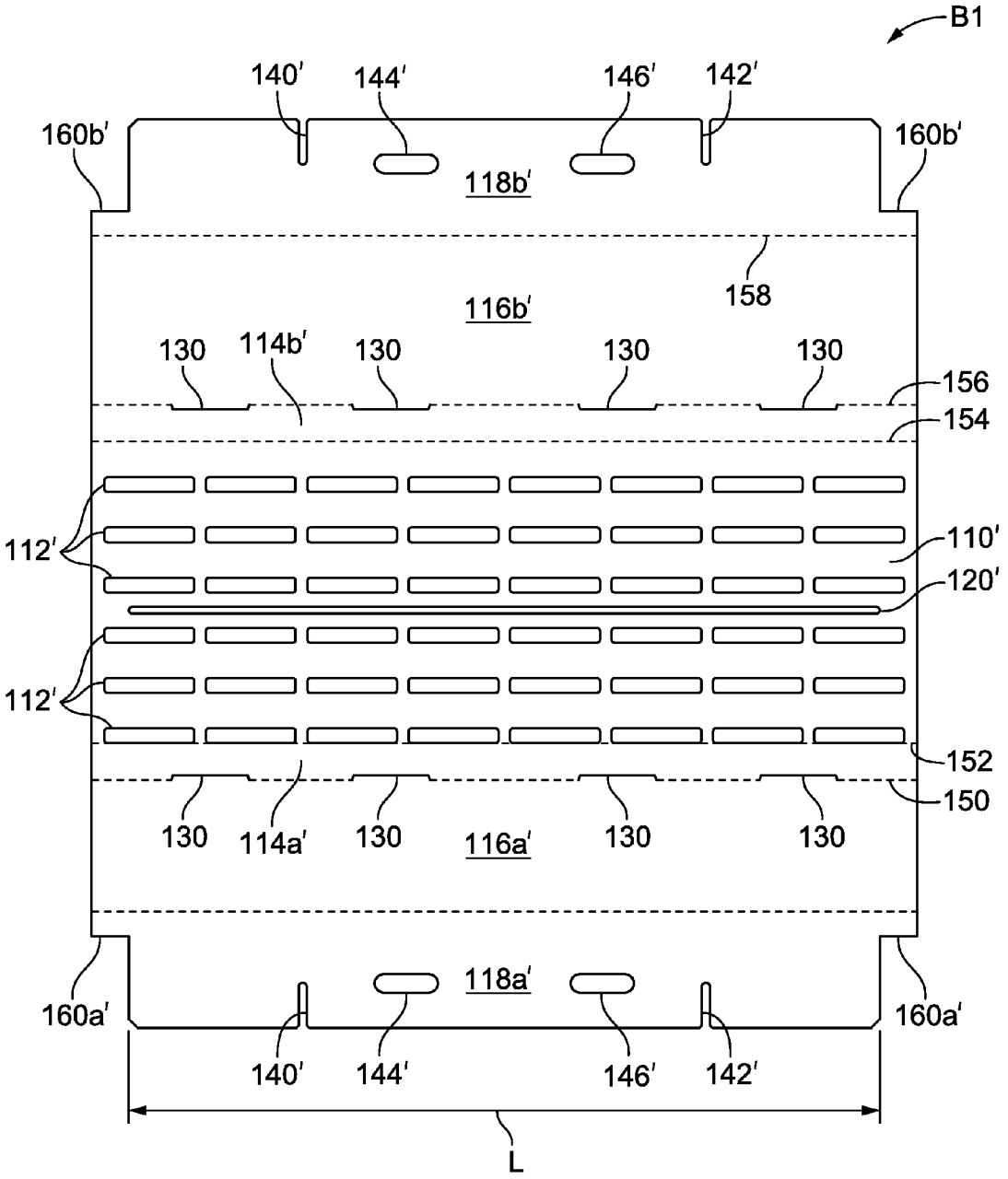
FIG. 3 is a plan view of a paperboard blank B1 for making the tubular open-ended tray 102 shown in FIGS. 1 and 2.

FIG. 1 is an exploded perspective view of an integrated tray 100 having a tubular open-ended tray 102, two horizontal dividers 104*a* &104*b*, articles 106, and a support pad 108 all in spaced relationship with one another in accordance to a preferred embodiment of the invention. The tubular open-ended tray 102 includes an article support panel 110 comprises a plurality of apertures 112 formed therein for supporting articles 106 in an upright position. Opposite side walls 114*a*, 114*b* are foldably joined to opposite longitudinal sides of the article support panel 110 and extending downwardly therefrom and are foldably joined to floor panels 116*a*, 116*b*. The floor panels 116*a*, 116*b* extend inwardly from the respective side walls 114*a*, 114*b* toward one another beneath the article support panel 110 in spaced relationship to the article support panel 110. Girder or carry handle panels 118 is defined by two identical girders or carry handle panels 118*a*, 118*b* as best seen in FIG. 3. The girders or carry handle panels 118*a*, 118*b* are foldably joined to the respective floor panels 116*a*, 116*b* and extending upwardly in contiguous relationship to one another through an elongated slot 120 in the article support panel 110 to form a carry handle for the integrated tray 100 as will be discussed in greater detail hereinafter. At least one divider or preferably two identical dividers 104*a*, 104*b* each of which is removably attached to the tubular open-ended tray 102 so as to provide compression capability when the integrated tray 100 are stacked on top of one another. Each of the two dividers 104*a*, 104*b* has respective web panels 122, 124 extending transversely across the tubular open-ended tray 102 and respective flanges 126, 128 extending longitudinally of the tubular open-ended tray 102 as will be discussed in greater detail hereinafter. Each of the web panels 122, 124 comprises a respective male slot 136, 138 used to engage with a respective female slot 140, 142 of the girder or carry handle panel 118. The respective female slot 140, 142 receives the respective male slot 136, 138 of the respective two dividers 104*a*, 104*b* to securely affix the dividers to the tubular open-ended tray 102. The flange 126 is defined by four flanges 126*a*, 126*b*, 126*c*, 126*d* and the flange 128 is defined by flanges 128*a*, 128*b*, 128*c*, and 128*d*.

Figure 2:
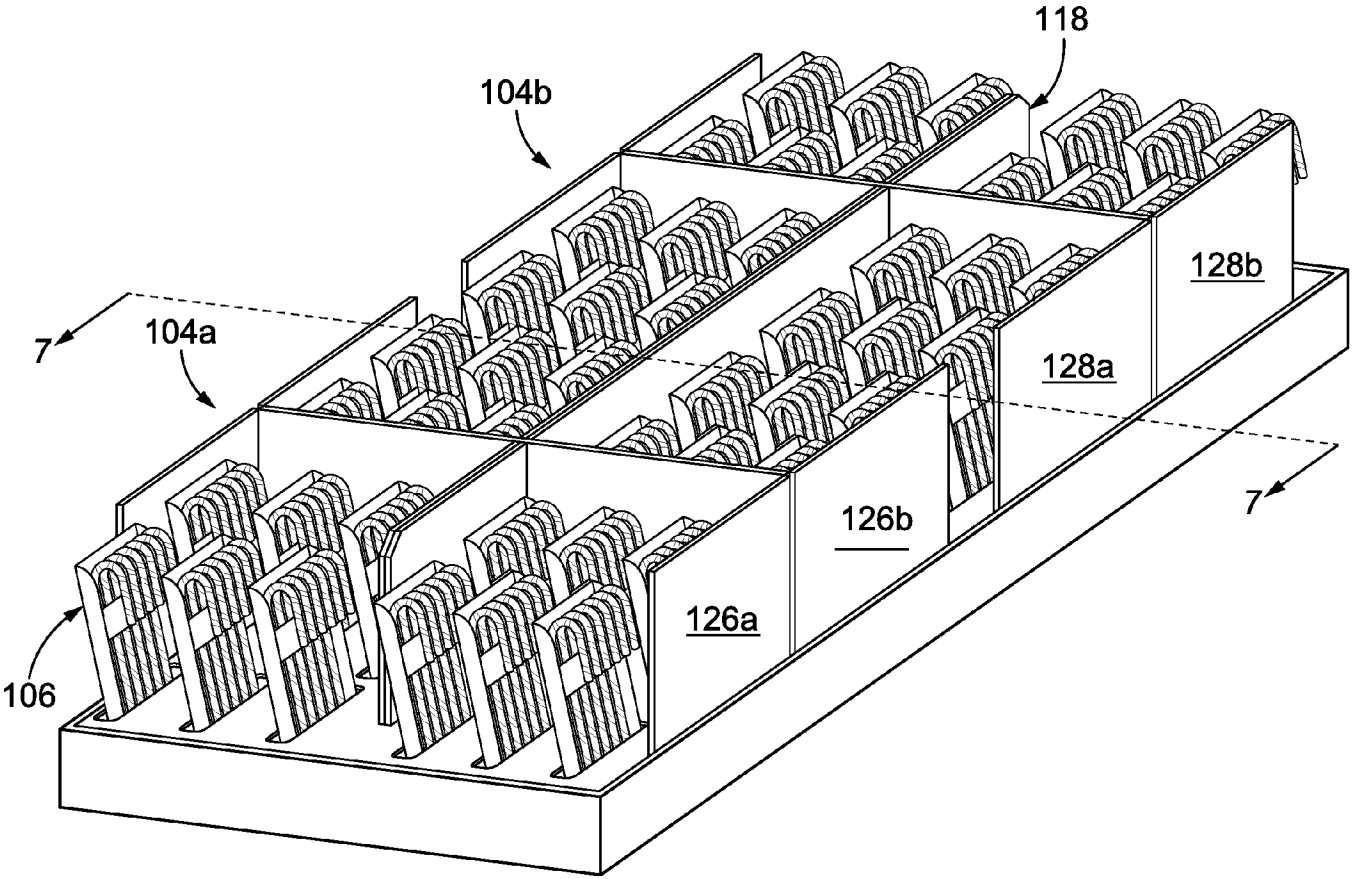
FIG. 2 is a top perspective view of the integrated tray of FIG. 1 in an assembled position, and illustrating the integrated tray loaded with articles therein according to the invention.

Each of the four flange panels 126*a*, 126*b*, 126*c*, 126*d* includes a respective locking tab 132 projected from respective free edges thereof and is inserted into a respective plurality of the slots 130 formed on each of the opposed side walls 114*a*, 114*b*. Similarly, each of the four flange panels 128*a*, 128*b*, 128*c*, 128*d* includes a respective locking tab 132 projected from respective free edges thereof and is inserted into a respective plurality of the slots 130 formed on each of the opposed side walls 114*a*, 114*b*. The girder 118 is also function as a carry handle panel having two hand holes 144, 146 formed therein to permit a user to carry the integrated tray 100. In use, the tubular open-ended tray 102 is placed onto the support pad 108, then the article 106 is put into the tubular open-ended tray 102 and finally each of the dividers 104*a*, 104*b* is attached to the tray 102 as seen best in FIG. 2. The support pad 108 is used for stacking the integrated trays on top of one another. As illustrated in FIG. 2, the integrated tray 100 contains articles 106 such as packages of candy canes, but one of ordinary skill in the art would appreciate that other articles such as, but not limited to, groups of DVD's, CD's or other type of digital media, plastic cases containing product for sale, and various types of consumer and industrial products, or the like, may also be contained therein.

FIG. 3 is a plan view of a cut and scored paperboard blank B1 for forming the tubular open-ended tray 102 depicted in FIGS. 1 and 2. The blank B1 is substantially flat symmetrical with respect to its lateral or longitudinal axis thereof. The blank B1 is preferably an integral piece of a material such as continuous sheet of conventional corrugated paperboard. The blank B1 is cut along its outer margins to form its specific shape. The blank B1 is divided into girders or carry handle panels 118*a*', 118*b*', floor panels 116*a*', 116*b*', Opposite side walls 114*a*', 114*b*', and an article support panel 110' by parallel fold lines 148, 150, 152, 154, 156 and 158. For example, the respective girders or carry handle panels 118*a*', 118*b*' are defined by respective fold lines 148 and 156. The floor panel 116*a*' is defined by the two fold lines 148, 150 and the floor plan 116*b*' is defined by the two fold lines 156, 158. The opposed side walls 114*a*', 114*b*' are defined by fold line 150, 152 and fold line 154, 156, respectively. Finally, the article support panel 110' is defined by the two parallel fold lines 152 and 154. The elongated slot 120' is formed in the central portion of article support panel 110'. The length of the elongated slot 120' is formed so that it corresponds to a length (L) of the respective girders 118*a*', 118*b*' which permits the girders 118*a*', 118*b*' be inserted through the elongated slot 120'. The plurality of apertures 112 are formed onto the article support panel 110 for supporting articles 106 in an upright position when the blank B1 is fully constructed. The shape, size, and number of the slots or apertures 112 are not limited, but depend on shape and size of the articles supported by the integrated tray.

The plurality of the slots 130 are formed on the respective longitudinal edges of each of the opposed side walls 114*a*, 114*b* that correspond to the number of the respective locking tabs 132 projected from respective free edges of the four flange panels 126*a*, 126*b*, 126*c*, 126*d*. Each of the respective girders or carry handle panels 118*a*', 118*b*' includes a respective pair of spaced apart female slot 140', 142' formed from respective free edges toward the center of the girders. Each of the respective girders or carry handle panels 118*a*', 118*b*' includes a respective pair of spaced apart hand holes 144', 146' formed therein to permit a user to carry the integrated tray 100. Each of the respective girders or carry handle panels 118*a*', 118*b*' further includes a respective pair of ledges 160*a*, 160*b* each of which extends outwardly from length (L) and terminates at the respective side edges of the girders 118*a*', 118*b*'. When the blank B1 is fully constructed, the ledges 160*a*', 160*b*' rest underneath of the article support panel 110' so as to form the tubular open-ended tray 102 and support the floor panels 116*a*', 116*b*'. The weight of the articles 106 contained in the integrated tray 100 are supported by the floor panels 116*a*', 116*b*' and the ledges 160*a*', 160*b*'.

Figure 4B:
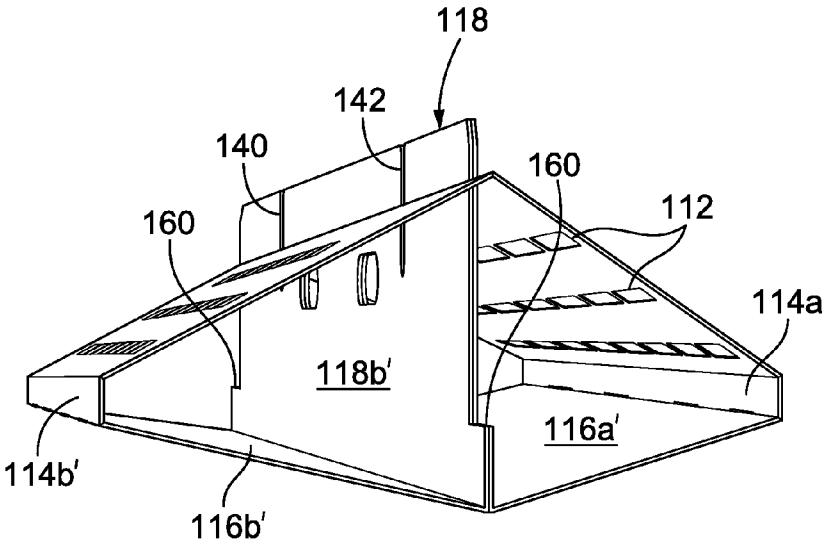
FIGS. 4A-4D illustrate the folding sequences of the blank B1 shown in FIG. 3 for constructing the tubular open-ended tray in accordance to the preferred embodiment of the present invention.
Figure 4A:
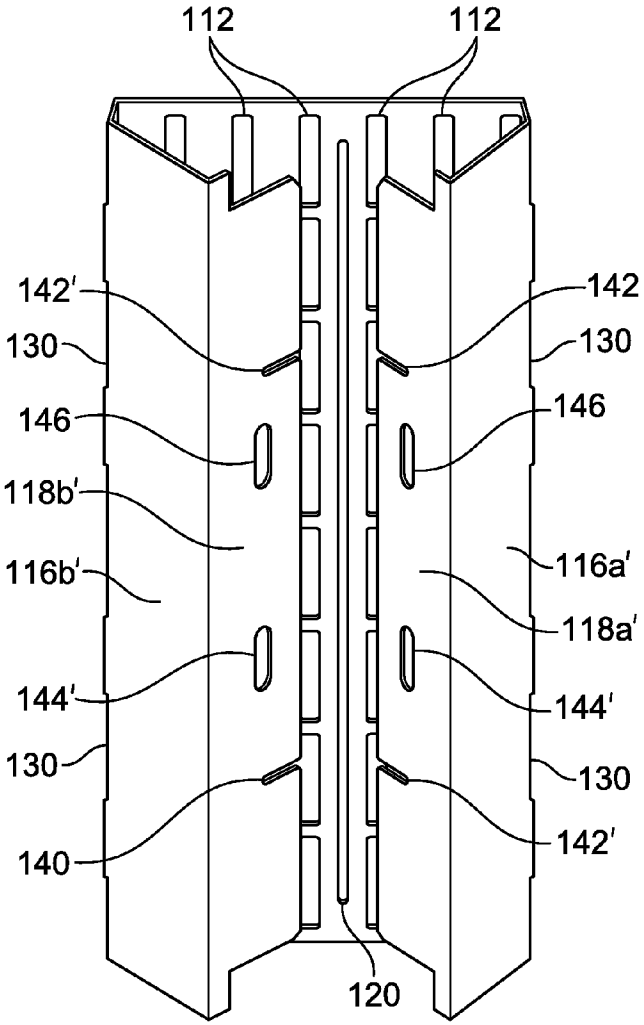
Figure 4C:
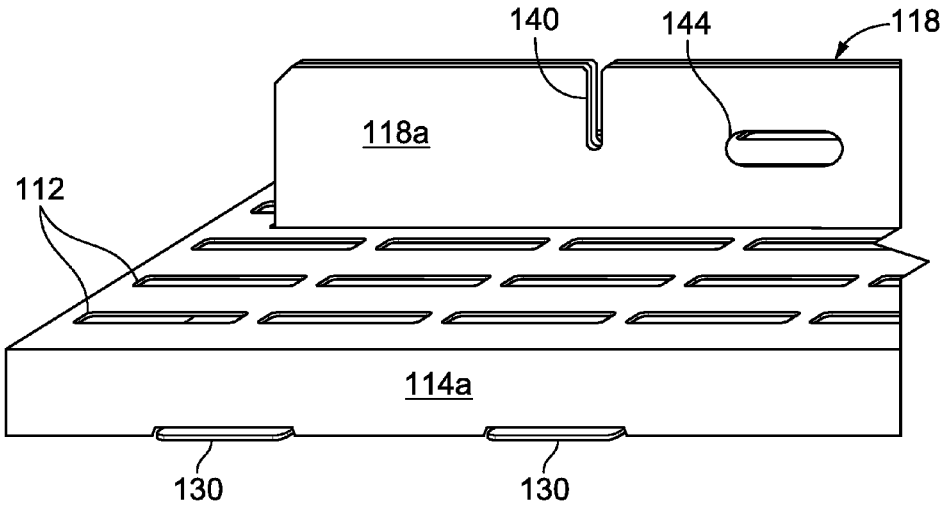
Figure 4D:
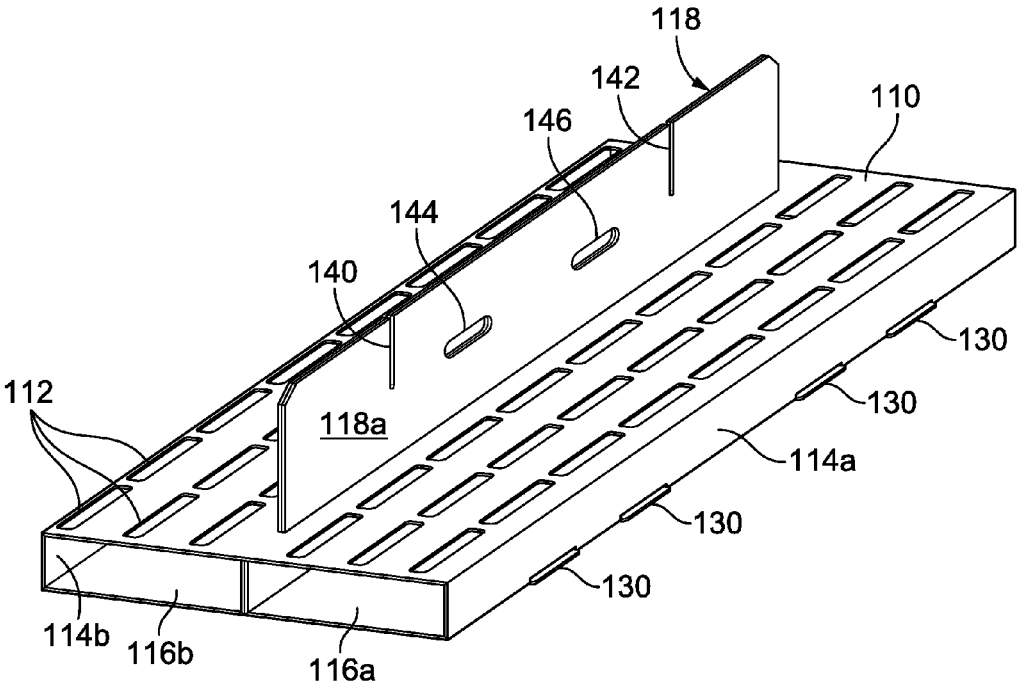

Referring to FIGS. 4A-4D, manual set-up of the tubular open-ended tray 102 is easily accomplished. However, a person of ordinary skill in the art would appreciate that generally a folding machine may alternatively perform the forming operations. The blank B1 is laid horizontally and then the girders or carry handle panels 118*a*', 118*b*' and the floor panels 116*a*', 116*b*' are simultaneously folded along the respective fold lines 152 and 154 while carry handle panels 118*a*', 118*b*' are folded along respective fold lines 148, 158 so that the carry handle panels 118*a*', 118*b*' are inserted into the elongated slot 120' as depicted in FIGS. 4A-4B. It should be noted that the two girders or carry handle panels 118*a*', 118*b*' are identical and they are in registry with one another when they are extending upwardly through the elongated slot 120' as illustrated in FIGS. 4B-4D. The girder or handle panel 118 functions like a center beam having two handle panels extending upwardly in contiguous relationship to one another. This center beam provides for longitudinal stability of the tray and forms a structure onto which separate parts can be easily attached. The girder or handle panel or center beam 118 can incorporate hand-holds 144, 146, if desired, to allow for the integrated tray 100 to be easily moved, either during the production process, or when placing it on the final pallet for shipment. The girder or handle panel or center beam 118 is formed with female slots 140, 142 in it which horizontal dividers 104*a*, 104*b* could be inserted, thus firmly affixing these dividers to the tubular open-ended tray 102 and providing top to bottom compression capability. The tubular open-ended tray 102, when fully constructed, forms two identical rectangular tubes separated by the vertically formed girder or carry handle panel 118. The heights of the rectangular tubes are determined by the width of the respective side walls 114*a*, 114*b* and they help in retaining the articles 106 in an upright position and preventing from falling forward or backward.

Figure 5A:
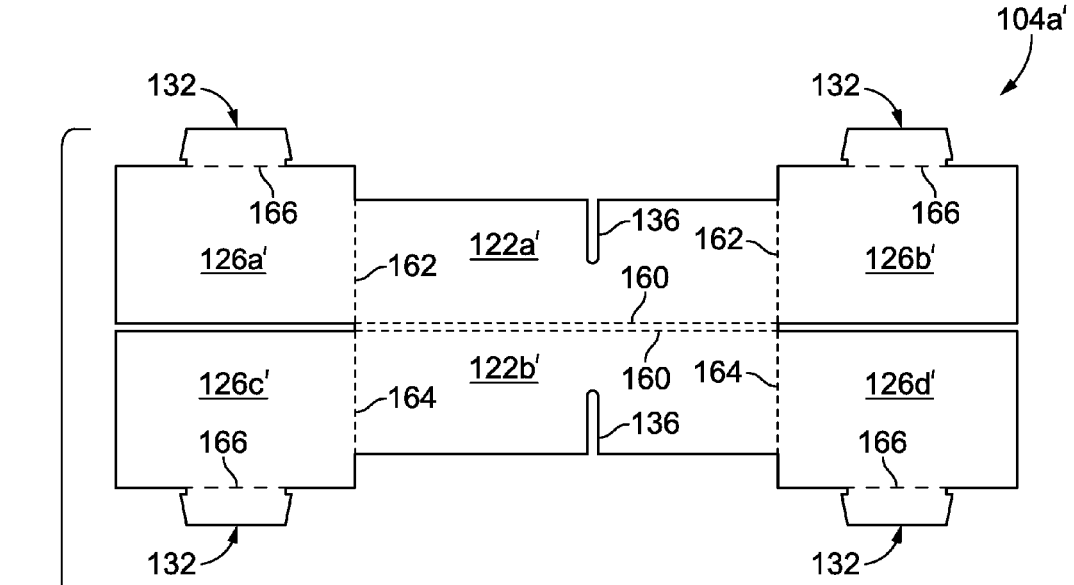
FIGS. 5A and 5B are respective plan view of paperboard blanks B2 for making the respective dividers 104*a*, 104*b* shown in FIGS. 1 and 2.
Figure 5B:
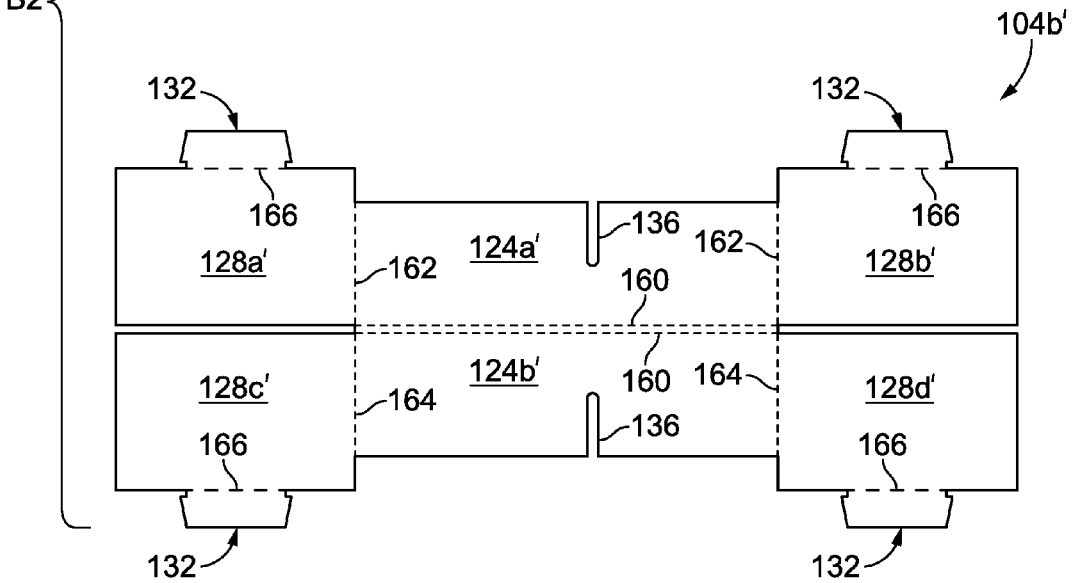
Figure 6B:
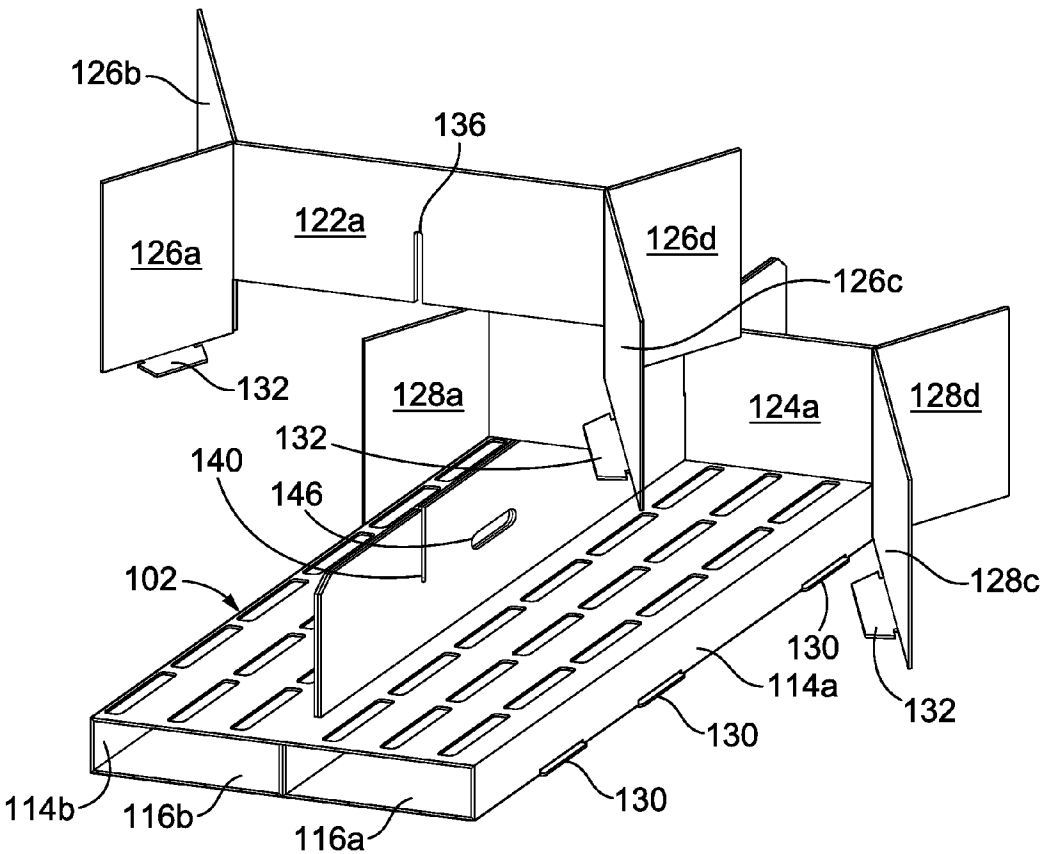
FIGS. 6A-6D illustrate the manner in which the respective blanks B2 for making dividers are folded and configured to be attached to the tubular open-ended tray.
Figure 6A:
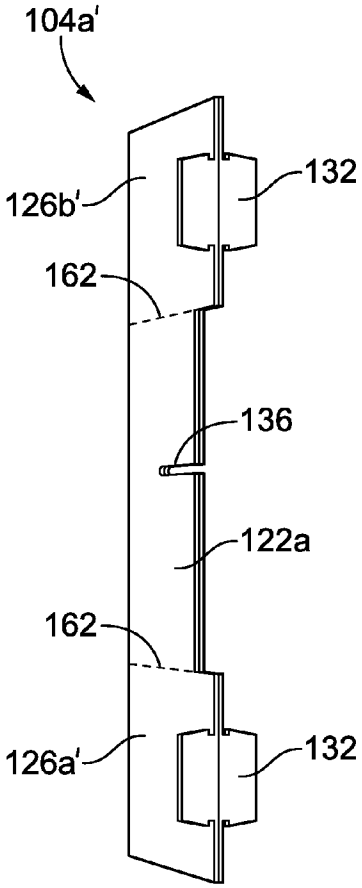
Figure 6C:
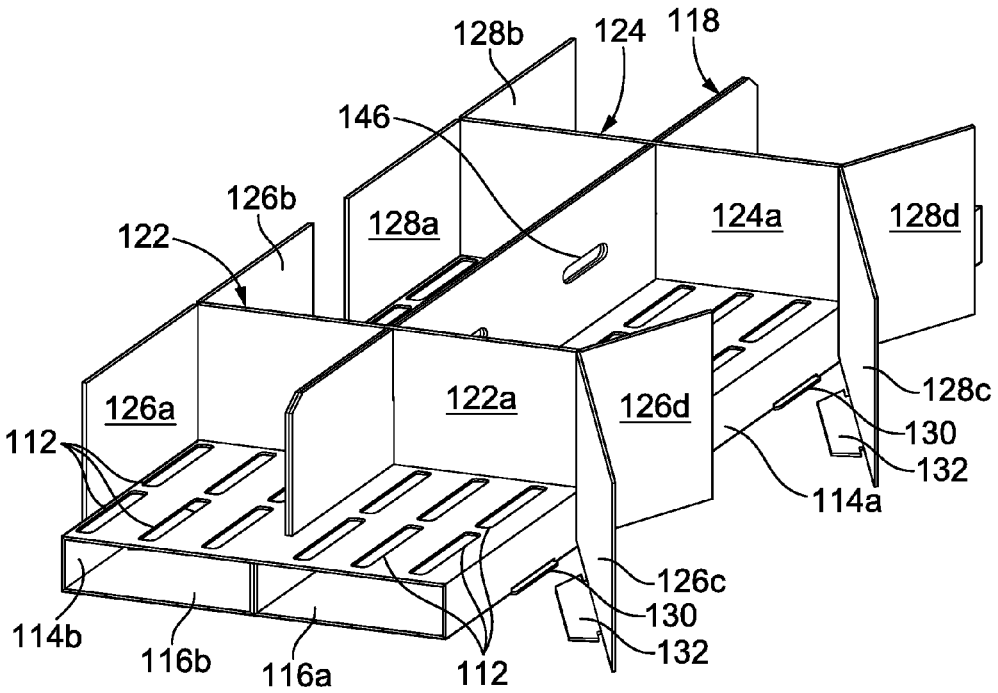
Figure 6D:
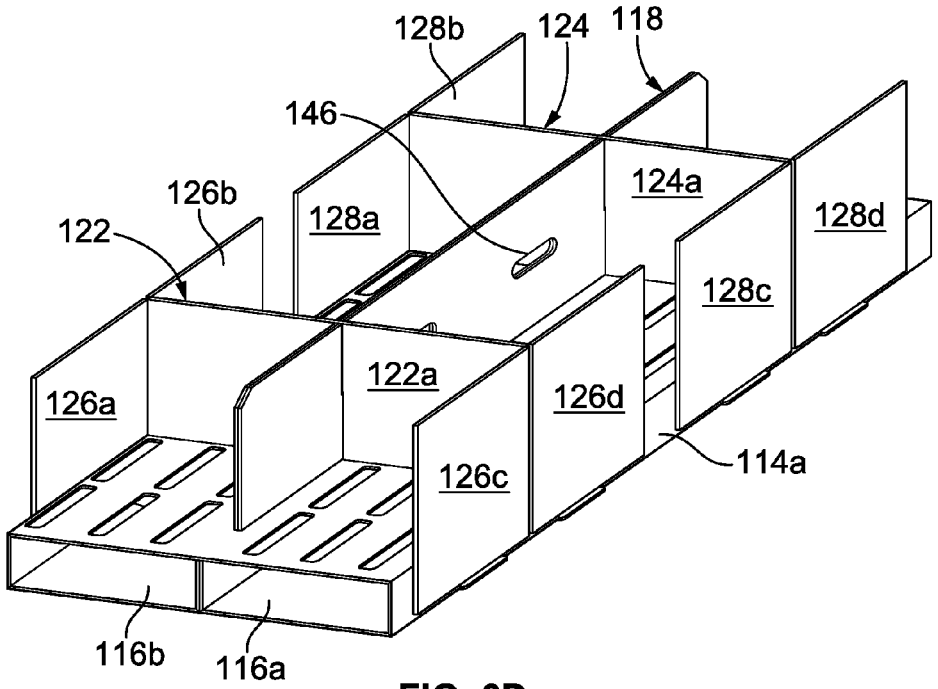

FIGS. 5A and 5B are respective plan view of the respective paperboard blanks 104*a*' and 104*b*' for making the respective dividers 104*a* and 104*b* as shown in FIGS. 1 and 2. The two identical blanks being defined by second and third blanks 104*a*', 104*b*' each of which comprises two identical rectangular-shaped panels foldably joined to one another. Since the respective blanks 104*a*' and 104*b*' are identical in shape, form, and their intended function, then one of blanks, for example, the second blank or blank 104*a*' is described in greater detail hereinafter in which the description for the blank 104*a*' is equally applicable to the blank 104*b*'. The blank 104*a*' includes respective web panels 122*a*', 122*b*' defined by two parallel score lines 160. Each of the web panels 122*a*', 122*b*' comprises a respective male slot 136 used to engage with a respective female slot 140 of the girder or carry handle panel 118. Each of the web panels 122*a*', 122*b*' includes a respective pair flanges 126*a*', 126*b*' and 126*c*', 126*d*'. For example, each of the flanges 126*a*' and 126*b*' foldably extends from respective lateral edges of the web panels 122*a*' via fold lines 162 and each of the flanges 126*c*' and 126*d*' foldably extends from respective lateral edges of the web panels 122*b*' via fold lines 164. Each of the respective flanges 126*a*', 126*b*', 126*c*', and 126*d*' includes a respective locking tab 132 foldably projected from respective free edges of the respective flanges 126*a*', 126*b*', 126*c*', and 126*d*' via respective fold lines 166. It should be noted that the respective flanges 126*a*' and 126*c*' are formed apart from one another so that each of them can be rotated independently. The distance between the flanges 126*a*' and 126*c*' correspond to the distance between the two parallel score lines 160. Similarly, the respective flanges 126*b*' and 126*d*' are formed apart from one another so that each of them can be rotated independently. The distance between the flanges 126*b*' and 126*d*' correspond to the distance between the two parallel score lines 160. As noted hereinabove, the description for the blank 104*b*' is the same as the blank 104*a*' and will not be repeated herein to avoid redundancy.

FIGS. 6A-6D illustrate the manner in which the respective blanks B2 for making horizontal dividers 104*a*, 104*b* are folded and configured to be attached to the tubular open-ended tray 102. First, each of the respective horizontal dividers 104*a*', 104*b*' are folded along their respective score lines 160. Next, each of the respective horizontal dividers 104*a*', 104*b*' are attached to the girder or carry handle panel 118 by engaging the respective male slot 136 with a respective female slot 140. Finally, the respective locking tabs 132 are inserted into the respective slot 130 to securely affix the respective dividers 104*a*, 104*b* to the tubular open-ended tray 102. When assembled, the respective dividers 104*a*, 104*b* would allow for several integrated trays to be stacked on top of one another in two or more rows. The horizontal dividers 104*a*', 104*b*' can be inserted at multiple points and in the number required for the needed top to bottom compression and horizontal stability.

Figure 7:
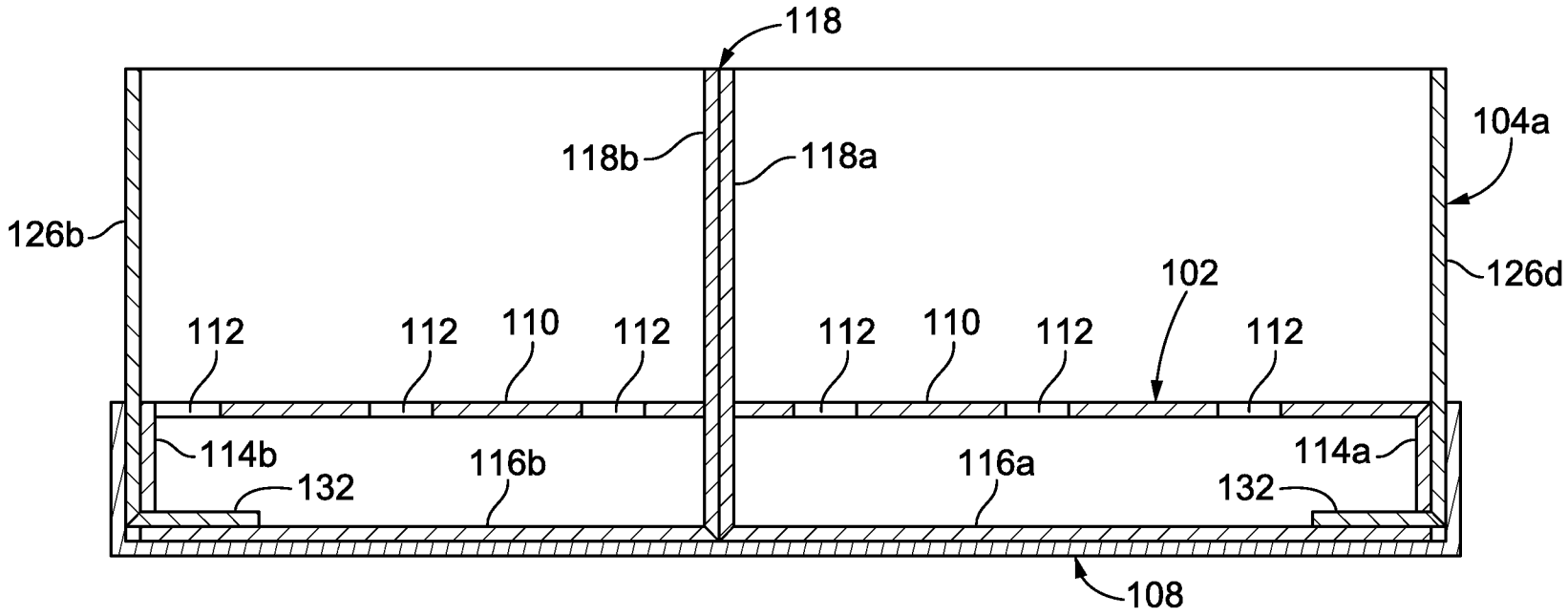
FIG. 7 is a cross-sectional view taken along line 7-7 in FIG. 2.

FIG. 7 is a cross-sectional view taken along line 7-7 in FIG. 2 which illustrates elevation and detail of engagement of the tubular open-ended tray 102, the divider 104*a*, articles 106, and a support pad 108 with respect to one another. For example, the height of the tubular open-ended tray 102 provides enough space for each article 106 to securely retain in the tray without falling forward or backward during transportation of the integrated tray. The size and shape of the apertures 112 in the article support panel 110 can be placed in any configuration, and the height between the floor panel 116 and the article support panel 110 can be either increased or decreased, depending on the type of product to be packaged, and the shape of the articles to be packed. It should also be noted that with respect to the position of the girder 118, one side of the tray is slightly wider than the other side of the tray since the tip of articles 106 in the first row are tilted a bit backward; therefore, it requires enough space for the bottom of the articles 106 to position forward. Although the support pad 108 has a U-shaped cross section, but one of ordinary skill in the art would appreciate that other support pads such as a plain paperboard sheet or the like may be used accordingly. When the integrated tray are stacked on top one another, the bottom edges of each of the flanges 126 and 128 sit on the support pad that are used to absorb the compression force exerted by the weight of the integrated tray 100. As an alternative embodiment, a single or double ply stacking tabs can be formed on the central portion of the two parallel score lines 160 on the boundary of the respective web panels 122*a*', 122*b*' so that the respective stacking tabs is inserted to the corresponding slots formed on the respective floor panels 116*a*', 116*b*'. Each of the stacking tabs is projected upwardly from upper edge of the respective web panels 122 and 124. By using the stacking tabs configuration, the support pad 108 can be eliminated. The integrated tray 100 of the present invention is simple and economical in construction, requiring minimal parts and material, and effectively holds a plurality of articles 106 in upright position when displayed for sale.

Three blanks are illustrated herein, one blank for the tubular open-ended tray 102 and two identical blanks for horizontal dividers 104*a*, 104*b* for the integrated tray 100 according to the present invention. In the blanks illustrations, unless otherwise indicated, the usual drawing conventions are applied, wherein solid lines on the interior of a blank, indicate an aperture or complete through cut, and broken lines indicate a fold line, a line of weakness such as a score, crease, perforation, or other means for weakening the blank, to permit breaking or folding.

Any dimensions, distances or other numerical values, that may be given in the description herein, or in the Figures, are given by way of example, and the present invention is not to be considered limited thereto.

This invention could be employed and practiced in a number of different ways. Among them are: The employment of the design in a retail display capacity, whereby an entire pallet of this product would be placed in the aisle of a retail establishment, displaying the product contained in the display to consumers. Given the ample incorporation of printable surfaces in any one of its multiple configurations, it provides for the ability to advertise the features, advantages and benefits of the product being sold in the display to consumers. As the various levels of the multi-level pallet display are emptied of product or "shopped down" a replacement level of product could be added to the display and therefore it could continue to be used in the retail display role.

Depending on the types of products to be packaged into this item, apertures can be die cut into the article support panel 110. These apertures or openings, whether completely cut out, or including a flapped opening can be placed in multiple locations in the article support panel. Furthermore, the shapes of these apertures or openings can be configured to match the shape outline and geometry of the product to be packaged, thereby securing it in the overall design throughout the distribution cycle of the corrugated item and the product to be shipped.

This corrugated article could be utilized to ship, among other possible items: small plastic cases containing product for sale, work-in-process components being transported from one location to another for the continuing of the manufacturing process of these items, groups of DVD's, CD's or other typed of digital media, various types of consumer and industrial products in addition to those previously mentioned.

While the invention has been described with reference to a preferred embodiment, it will be understood by those skilled in the art that various changes may be made and equivalents may be substituted without departing from the scope of the invention. In addition, many modifications may be made to adapt a particular situation or material to the teachings of the invention without departing from its scope. Therefore, it is intended that the invention not be limited to the particular embodiment disclosed, but that the invention will include all embodiments falling within the scope of the appended claims.

What is claimed is:

1. A tubular open-ended tray for holding and retaining a plurality of articles contained therein, comprising:

a floor panel, an article support panel being foldably joined to the floor panel in a spaced apart relationship, the article support panel includes a plurality of apertures formed therein to securely retain the plurality of articles therein, wherein the article support panel and the floor panel are foldably joined to one another via two opposed side walls each of which extends from respective longitudinal edges of the floor panel and the article support panel, a girder foldably joined to the floor panel and extending upwardly therefrom and being engaged with the article support panel to form the tubular open-ended tray;

at least one divider is configured to be removably attached to the tubular open-ended tray wherein the at least one divider having at least one web panel extending transversely across the tray and at least one flange panel extending longitudinally of the tray; and a plurality of slots formed on each of the two opposed side walls wherein the plurality of slots are used to engage with the at least one divider.

2. The tubular open-ended tray of claim 1 wherein the at least one divider includes two identical dividers each of which is transversely mounted onto a longitudinal axis of the tubular open-ended tray.

3. The tubular open-ended tray of claim 1 wherein at least one web panel and the at least one flange panel are foldably joined to one another and wherein the web panel is defined by two rectangular-shaped panels coextensively folded onto one another and wherein the least one flange panel includes four flange panels each of which foldably extend from respective ends of each rectangular-shaped panels.

4. The tubular open-ended tray of claim 3 wherein each of the four flange panels includes a locking tab projected from respective free edges thereof and is inserted into the respective plurality of the slots formed on each of the opposed side walls.

5. The tubular open-ended tray of claim 3 wherein the at least one divider further comprises a male slot used to engage with the girder.

6. The tubular open-ended tray of claim 5 wherein the male slot is formed onto each of the rectangular-shaped panels.

7. The tubular open-ended tray of claim 1 wherein the article support panel includes an elongated slot formed in a central portion thereof to permit the girder being inserted through the elongated slot.

8. The tubular open-ended tray of claim 5 wherein the girder includes a female slot that receives the male slot of the at least one divider to securely affix the at least one divider to the tubular open-ended tray.

9. The tubular open-ended tray of claim 1 wherein the girder is a carry handle panel having two hand holes formed therein to permit a user to carry the integrated tray.

10. The tubular open-ended tray of claim 7 wherein the girder is defined by two identical carry handle panels foldably joined to the floor panel and extending upwardly in contiguous relationship to one another through the elongated slot in the article support panel.

11. A tubular open-ended shipping and display tray for holding and retaining a plurality of articles contained therein in an upright position at a point of sale, the tray formed from a single unitary blank, comprising:

an article support panel having a plurality of apertures therein for supporting articles in the upright position, opposite side walls foldably joined to longitudinal opposite sides of the article support panel and extending downwardly therefrom, floor panels foldably joined to each of the side walls, the floor panels extending inwardly from the respective side walls toward one another beneath the article support panel in spaced relationship to the article support panel, wherein the article support panel and the floor panel are foldably joined to one another via two opposed side walls each of which extends from respective longitudinal edges of the floor panel and the article support panel and a handle panel foldably joined to each floor panel and extending upwardly in contiguous relationship to one another through a slot in the article support panel to form a carry handle for the tray, and at least one divider removably attached to the tray so as to provide compression capability when a plurality of said trays are stacked on top of one another, the at least one divider having at least one web panel extending transversely across the tray and at least one flange extending longitudinally of the tray and a plurality of slots formed on each of the two opposed side walls wherein the plurality of slots are used to engage with the at least one divider.

12. A plurality of blanks attached to one another for making an integrated tray, the plurality of blanks comprising:

a first blank comprising an article support panel having a plurality of apertures formed therein, the article support panel includes an elongated slot formed in a central portion thereof, opposite side wall panels being foldably joined to longitudinal opposite sides of the article support panel via first fold lines, floor panels each of which being foldably joined to each of the respective side wall panels via second fold lines, and girder panels each of which having two female slots formed therein and being foldably joined to the respective floor panels via third fold lines to form a tubular open-ended tray when the first blank being constructed; and two identical blanks being defined by second and third blanks each of which comprises two identical rectangular-shaped panels foldably joined to one another, each of the two rectangular-shaped panels includes two flange panels each of which foldably extends from respective opposed ends of the rectangular-shaped panel, each of the two rectangular-shaped panels includes a male slot formed therein which engaged with the female slot of the girder panels when the blanks being constructed and wherein each of the two flange panels includes a locking tab projected from respective free edges thereof.

13. The plurality of blanks of claim 12 wherein each of the opposed side wall panels includes four spaced apart slots formed on respective longitudinal edges thereof.

* * * * *